US006913467B2

(12) United States Patent
Huang

(10) Patent No.: US 6,913,467 B2
(45) Date of Patent: Jul. 5, 2005

(54) MULTIPLE SOCKET HAVING ROTATABLE SOCKET UNITS

(75) Inventor: Chyong-Yen Huang, Taipei (TW)

(73) Assignee: Atom Technology Inc., Taipei (TW)

( * ) Notice: Subject to any disclaimer, the term of this patent is extended or adjusted under 35 U.S.C. 154(b) by 0 days.

(21) Appl. No.: 10/632,986

(22) Filed: Aug. 4, 2003

(65) Prior Publication Data

US 2005/0032396 A1 Feb. 10, 2005

(51) Int. Cl.[7] ..... H01R 39/00
(52) U.S. Cl. ..... 439/22; 439/650
(58) Field of Search ..... 439/11, 13, 17, 439/22, 23, 2, 501, 502, 652, 650, 214; 174/50, 53

(56) References Cited

U.S. PATENT DOCUMENTS 4,726,784 A * 2/1988 Appleton ..... 439/409

* cited by examiner

*Primary Examiner*—Alexander Gilman
(74) *Attorney, Agent, or Firm*—Troxell Law Office, PLLC

(57) ABSTRACT

A multiple socket having rotatable socket units includes pivotally rotatable socket units at a housing. The housing has first and second conducting straps at an interior thereof. The first and second conducting straps are pivotally connected with first and second insertion straps in each socket unit. The socket unit is capable of driving the first and second insertion straps for further freely rotating relative to the housing. Using the above structure, the socket units are capable of adjusting directions thereof, thereby avoiding plugs from blocking insertion openings of adjacent socket units.

4 Claims, 7 Drawing Sheets

MULTIPLE SOCKET HAVING ROTATABLE SOCKET UNITS

BACKGROUND OF THE INVENTION (a) Field of the Invention

The invention relates to a multiple socket having rotatable socket units, and more particularly, to a multiple socket having rotatable socket units with each socket unit being capable of driving first and second conducting straps for further freely rotating relative to a housing thereof, thereby enabling electric appliance plugs having various sizes to be independent inserted with different angles.

(b) Description of the Prior Art

Referring to FIG. 7 showing a common multiple socket, the prior multiple socket has a plurality of sets of insertion openings A2 at a housing A1 thereof. The insertion openings A2 are disposed with equal distances in between, and the distances allow insertions of small-sized plugs without having the plugs interfering with one another. However, when the multiple socket is inserted by a plug B having a relatively larger volume (an adaptor plug for instance), the plug B frequently blocks another set of adjacent insertion openings A2, and the set of blocked insertion openings A2 then becomes idle and cannot be used. Suppose distances between the insertion openings A2 are increased, a length of the housing A1 is correspondingly increased with a volume thereof inevitably multiplied as well. Not only production cost is raised, but also inconveniences such as occupying excessive space are resulted. Therefore, the aforesaid type of multiple socket is hardly ideal when put to practical use.

SUMMARY OF THE INVENTION

The primary object of the invention is to provide a multiple socket having rotatable socket units and insertion openings having freely rotated angles, such that when large plugs are inserted at the multiple socket, directions of the socket units can be adjusted as desired without having the plugs blocking insertion openings of adjacent socket units. Consequently, all socket units of the multiple socket can be thoroughly utilized for bringing largest effects of the multiple socket.

The multiple socket having rotatable socket units comprises a plurality of pivotally rotatable socket units having spaces in between at a housing. The housing has first and second conducting straps at an interior thereof. The first and second conducting straps are pivotally connected with first and second insertion straps in the socket unit, such that each socket unit is capable of driving the first and second insertion straps and further freely rotating relative to the housing.

The invention is applicable to multiple sockets that generally have a plurality of sets of adjacent insertion openings. Each socket unit is provided with a set of insertion openings for inserting a plug. According to the invention, at least one socket unit at the multiple socket is disposed in a rotatable arrangement, so as to have insertion openings of adjacent socket units locate at different levels.

DETAILED DESCRIPTION OF THE PREFERRED EMBODIMENTS

To better understand the invention, detailed descriptions shall be given with the accompanying drawings hereunder.

Figure 1:
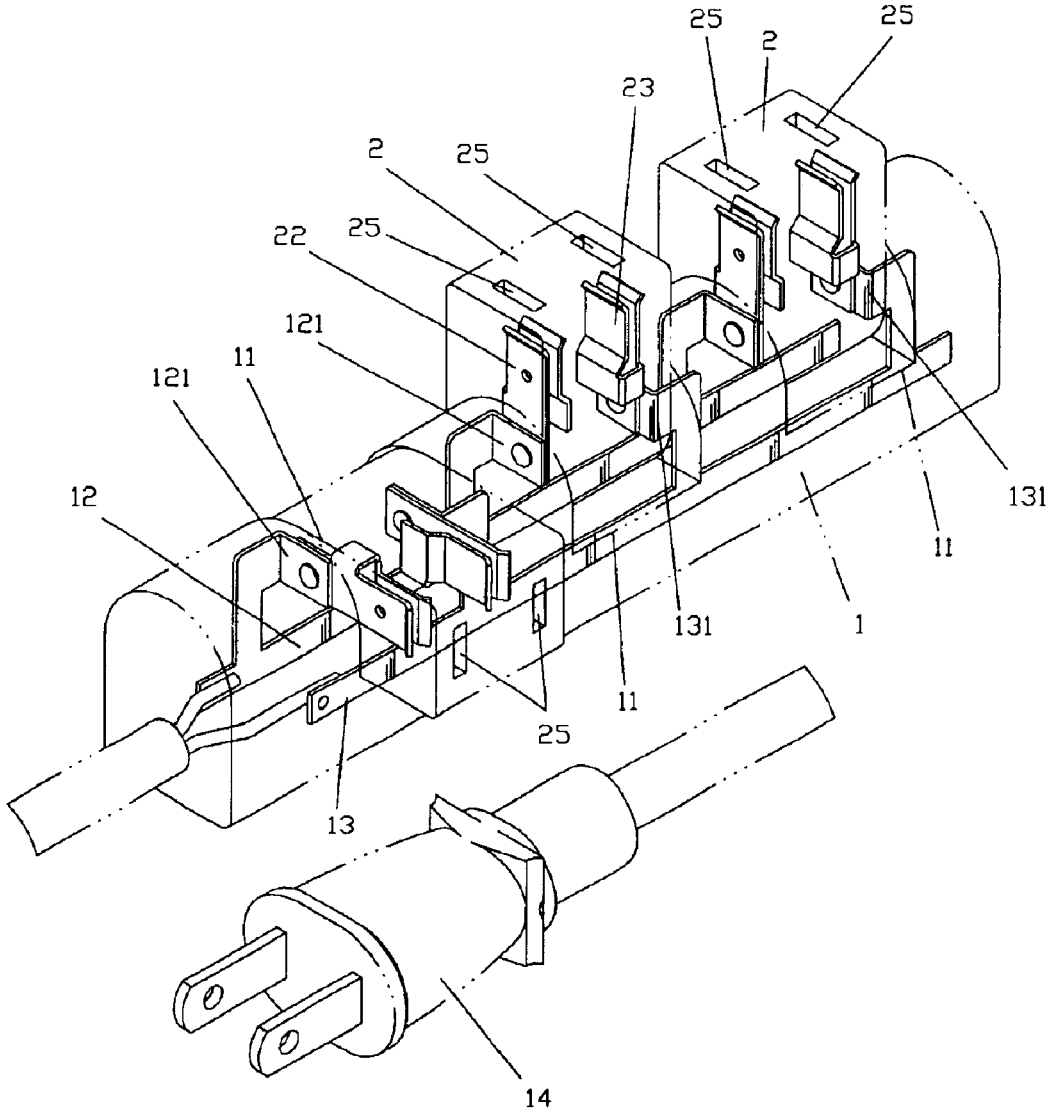
FIG. 1 shows an elevational view according to the invention.
Figure 2:
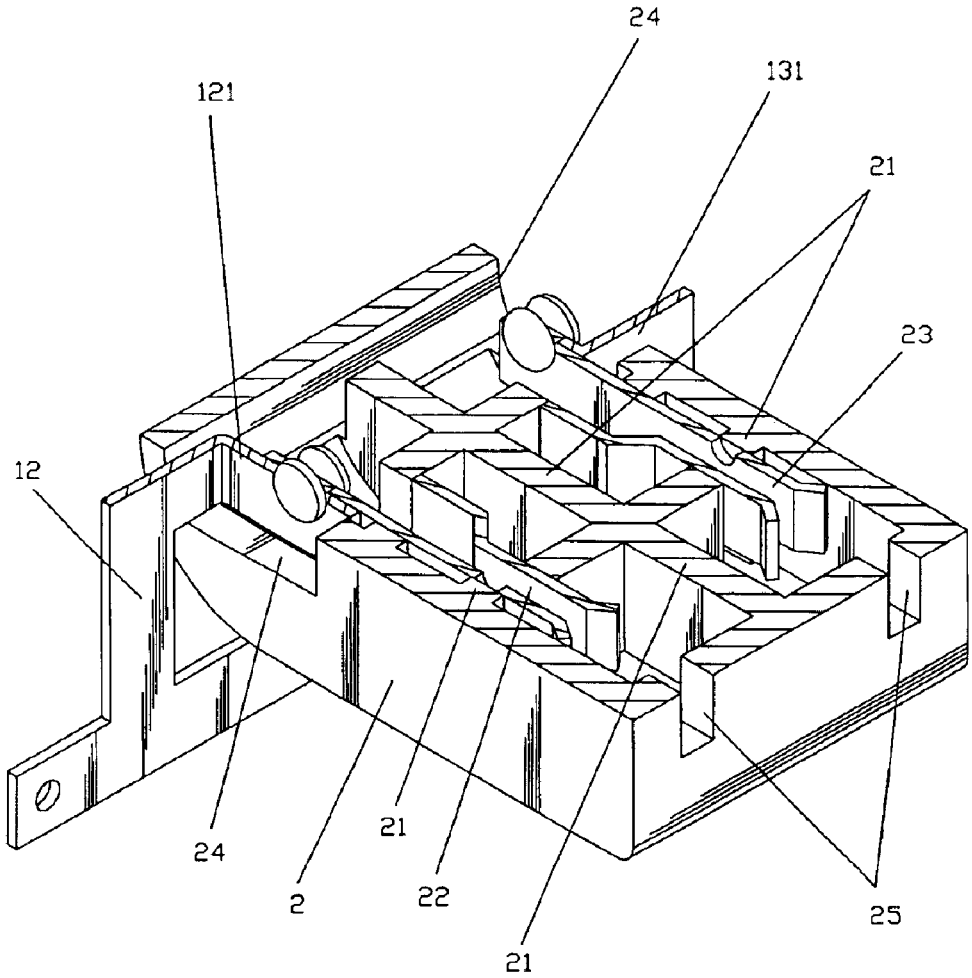
FIG. 2 shows a structural schematic view illustrating a socket unit according to the invention.

Referring to FIGS. 1 and 2 showing an embodiment according to the invention, all socket units of the multiple socket are disposed in a rotatable arrangement. The embodiment according to the invention comprises a housing 1 and a plurality of socket units 2.

The housing 1 has a plurality of notches 11, and a first conducting strap 12 and a second conducting strap 13 transversely disposed at an interior thereof. The first conducting strap 12 is a live wire, and the second conducting strap 13 is a ground wire. The first and second conducting straps 12 and 13 respectively have projecting pivotal ends 121 and 131 for corresponding with positions of the notches 11. End portions of the first and second conducting straps 12 and 13 are connected to a same power line, which has the other end thereof as a power plug 14.

The socket units 2 are provided in a quantity same as that of the notches 11 at the housing 1, and are disposed in the notches 11 at the housing 1. Each socket unit 2 has a plurality of flanges 21, and between the flanges 21 are a first insertion strap 22 and a second insertion strap 23. The first insertion strap 22 is a live wire contact point, and the second insertion strap 23 is a ground wire contact point. Each socket unit 2 further has an aperture 24 at two rear ends thereof for receiving the pivotal ends 121 and 131 of the first and second conducting straps 12 and 13, respectively. Ends of the first and second inserting strap 22 and 23 are pivotally connected with the pivotal ends 121 and 131 of the first and second conducting straps 12 and 13, respectively, so as to enable the socket unit 2 to freely rotate in the notches 11 at the housing 1. In addition, a front end of each socket unit 2 is disposed with two insertion openings 25, which are aligned with the first insertion strap 22 and the second insertion strap 23, thereby allowing insertions of the plugs B of various electric appliances.

Figure 3:
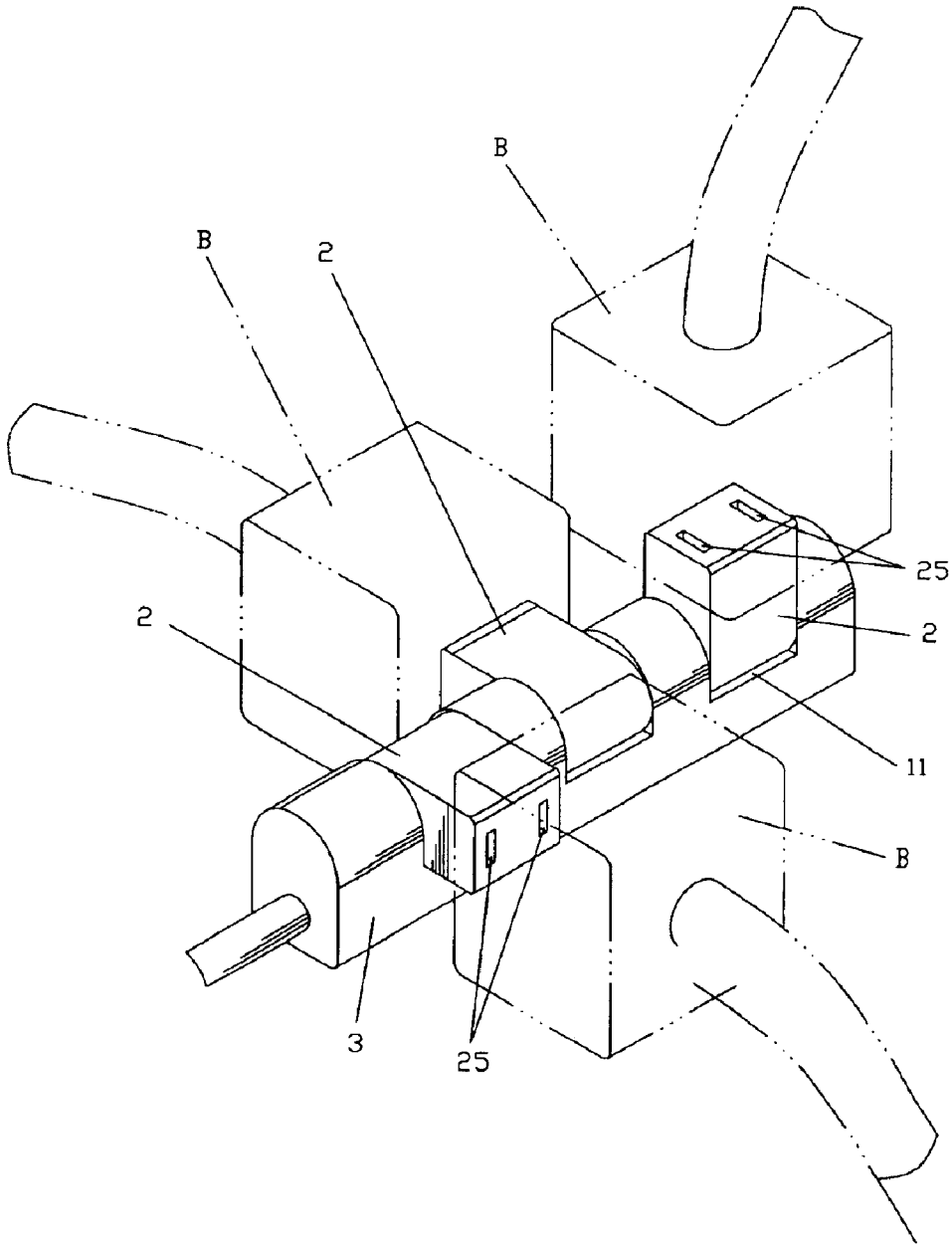
FIG. 3 shows a schematic view of an implementation according to the invention.
Figure 4:
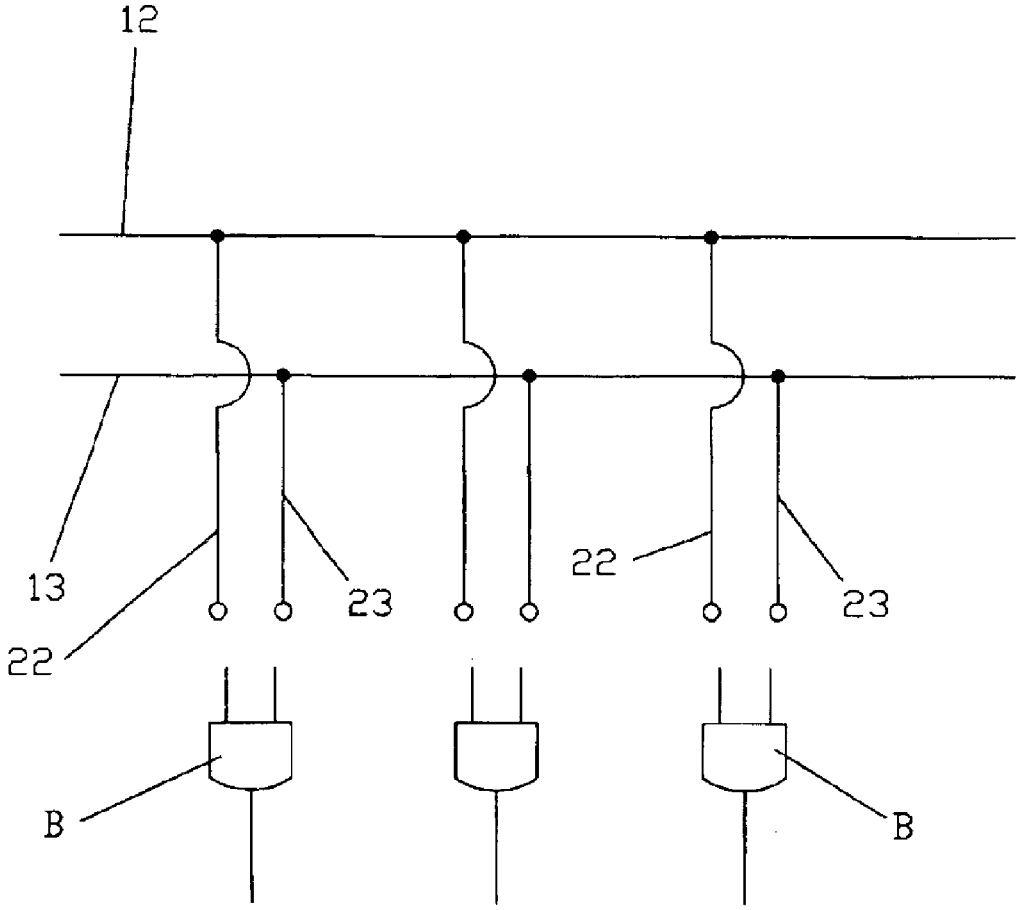
FIG. 4 shows a schematic view illustrating a conducted loop according to the invention.

Referring to FIGS. 3 and 4 showing the structure according to the invention being implemented, for that each socket unit 2 is pivotally connected with the housing 1, the socket units 2 are capable of freely rotating to different angles within the notches 11 at the housing 1, thereby enabling the insertion openings 25 of the socket units 2 to locate at different levels. When several plugs B having large volumes are inserted into insertion openings 25 of adjacent socket units 2, the plugs B are arranged in a staggered manner without interfering with one another. When each plug B is inserted into the insertion openings 25, the plug B is conducted with the first and second conducting straps 22 and 23. When the power plug 14 of the housing 1 is inserted to a power supply, the live wire of the power supply is passed through the first insertion strap 22 and transmitted to live wire pins of the plug B, whereas the ground wire of the power supply is passed through the second insertion strap 23 and transmitted to ground wire pins of the plug 14, so as to form a loop. Furthermore, regardless of rotated angles of the socket units 2, the first insertion strap 22 and the second insertion strap 23 of each socket unit 2 yet stay in contact with the first conducting strap 12 and the second conducting strap 13 for being pivotally connected. As a result, each socket unit 2 is capable of providing power at any angles, hence electric appliance plugs having various sizes can be independently and freely inserted into the socket units 2, thereby accomplishing thorough utilization of all socket units 2.

Figure 5:
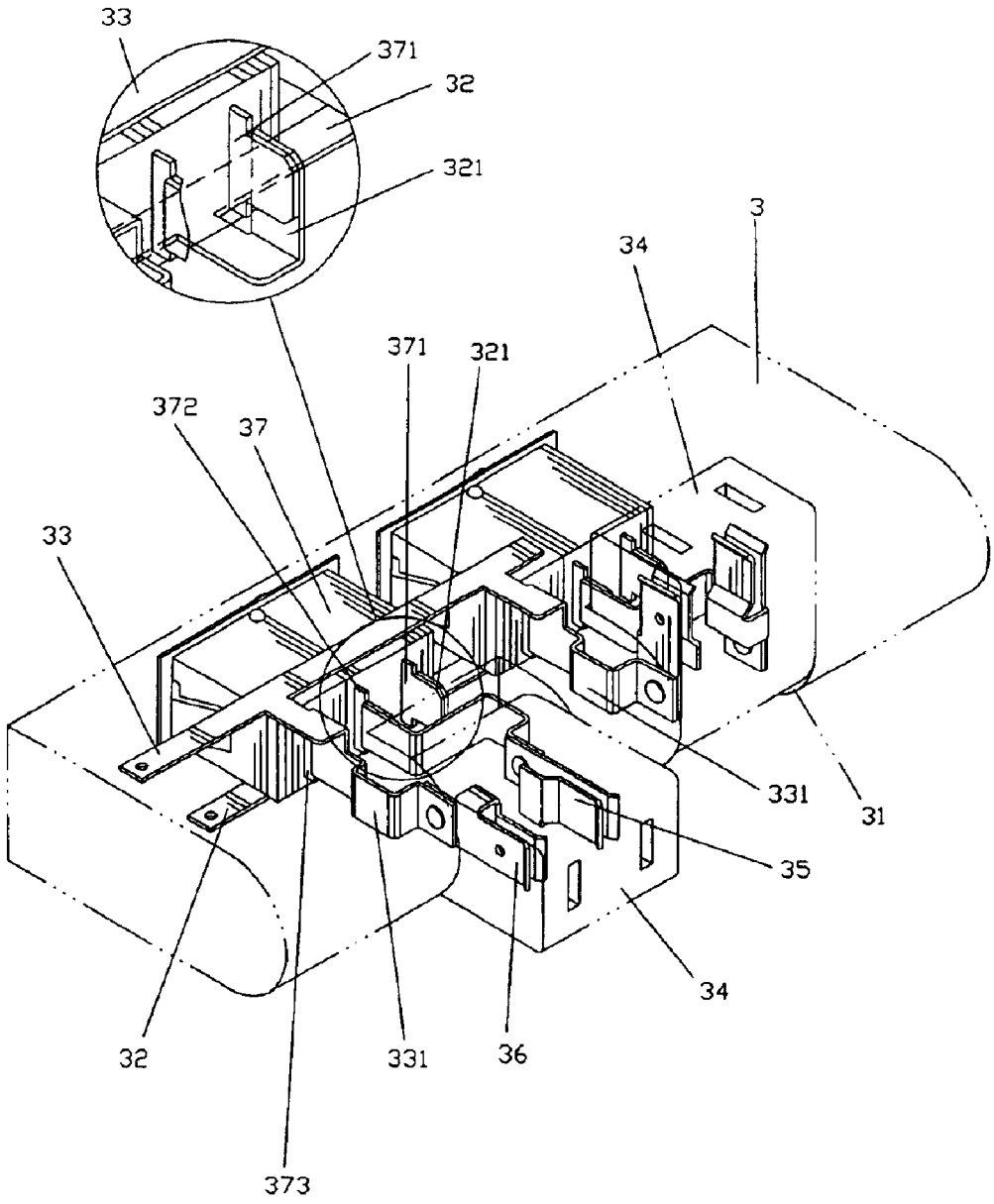
FIG. 5 shows an elevational view according of another embodiment according to the invention.
Figure 6:
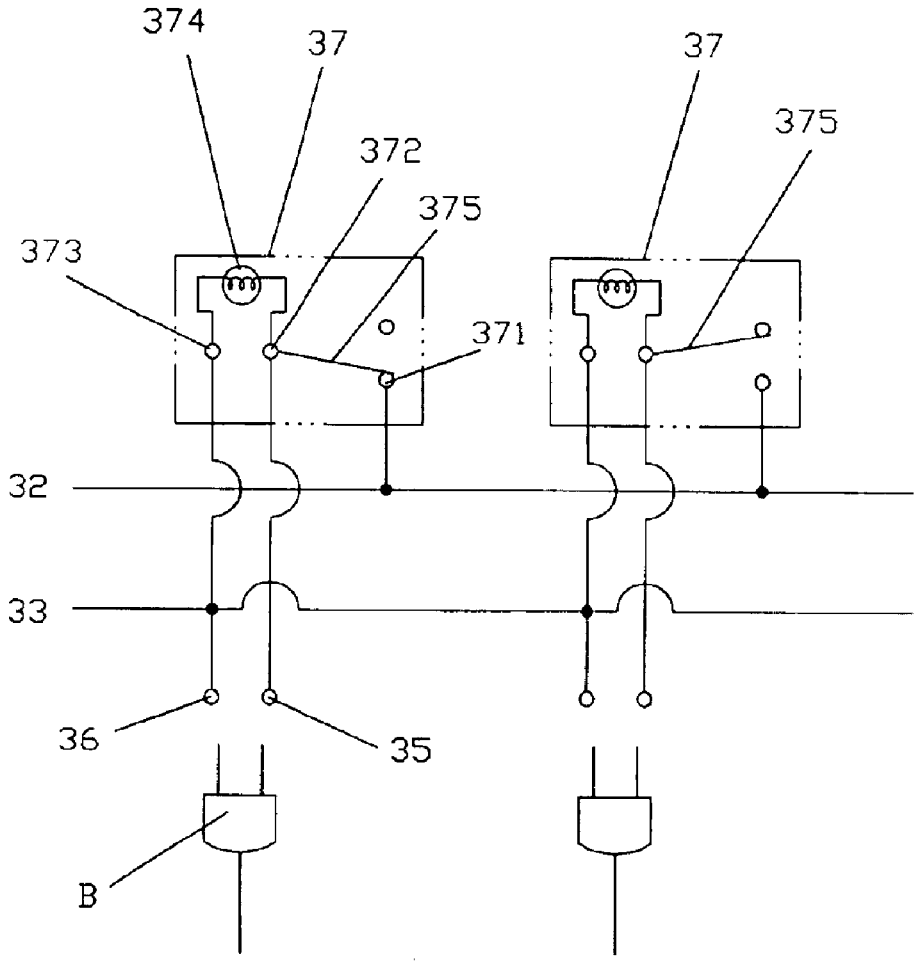
FIG. 6 shows a schematic view illustrating a conducted loop of another embodiment according to the invention.
Figure 7:
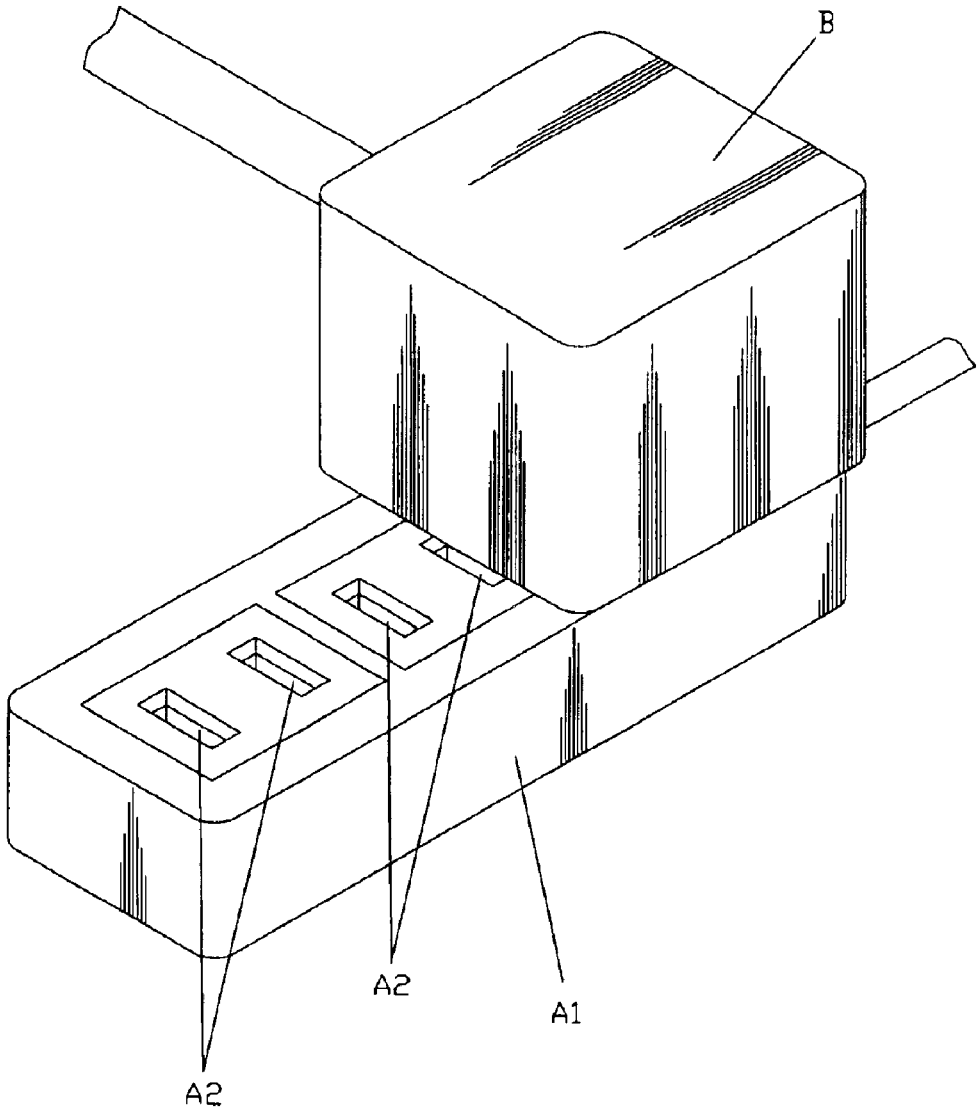
F I G. 7 PRIOR ART
FIG. 7 shows a conventional schematic view of a prior socket.

Referring to FIGS. 5 and 6 showing a second embodiment according to the invention, a housing 3 has a plurality of notches 31, and a conducting strap 32 and a second conducting strap 33 transversely disposed at an interior thereof. The first conducting strap 32 is a live wire, and the second conducting strap 33 is a ground wire. The first and second conducting straps 32 and 33 have pivotal ends 321 and 331 that are pivotally connected with a first insertion strap 35 and a second insertion strap 36 in a socket unit 34. The first insertion strap 35 is a live wire, and the second insertion strap 36 is a ground wire. The housing 3 further has press switches 37 corresponding to positions of the notches 31. Each press switch 37 is provided with first, second and third contact points 371, 372 and 373. The first contact point 371 is in communication with the pivotal end 321 of the first conducting strap 32, the second contact point 372 is in communication with the first insertion strap 35 in the socket unit 34, and the third contact point 373 is in communication with the pivotal end 331 of the second conducting strap 33 and the second insertion strap 36 in the socket unit 34. Moreover, between the second and third contact points 372 and 373 is an indication lamp 374. Each press switch 37 further has a finger 375. The finger 375 has one end thereof constantly connected and in communication with the second contact point 372, and the other end thereof come into contact with or departed from the first contact point 371 along with pressing of the press switch 37, so as to control cutting off and conductance of the first contact point 371 and the second contact point 372.

To use the structure according to the invention, the socket units 34 are turned to any desired angles in the notches 31 at the housing 3, such that the first and second insertion straps 35 and 36 are ready for inserting by the plugs B of various electric appliances. When the press switch 37 at the housing 1 is pressed down, the finger 375 in the press switch 375 conducts the first and second contact points 371 and 372. At this point, the indication lamp 374 between the second and third contact points 372 and 373 is lit up, so as to indicate presence of successful conductance. A live wire of a power supply is passed through the first conducting strap 32, the first contact point 371, the finger 374, the second contact point 372 and the first insertion strap 35 in sequence for transmitting the live wire of the plug B, whereas a ground wire of the power supply is passed through the second conducting strap 33 and the second insertion strap 36 for transmitting the ground wire of the plug B, thereby forming a loop. Consequently, plugs of electric appliance may be freely and independently inserted into the multiple socket in all directions. Also, in coordination with controls of the press switches 37, power in the socket units 2 can be turned on or off at all time, thus readily offering application conveniences.

In the two aforesaid embodiments, all the socket units 2 at the multiple socket are disposed in a rotatable arrangement. However, as long as one socket unit 2 among all the socket units 2 is disposed in a rotatable arrangement, interferences between other socket units 2 adjacent to the rotatable socket unit 2 and the rotatable socket unit 2 can be avoided.

It is apparent from the above description that the invention has the following excellences:

1. Each socket unit is capable of driving the first and the second insertion straps for further freely rotating relative to the housing, and hence insertion angles are provided with respect to the housing, with electric appliance plugs having larger volumes being inserted at different angles without interfering with one another, thereby thoroughly utilizing all the socket units of the multiple socket.
2. Without increasing a length of the multiple socket, numerous large-sized plugs can be accommodated and inserted, and therefore largest insertion capacity of a small-sized multiple socket is realized.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multiple socket having rotatable socket units comprising:

a) a housing having:
   i) a plurality of notches;
   ii) a first conductive strap having a plurality of first strap projecting pivotal ends, each of the plurality of first strap projecting pivotal ends being located in one of the plurality of notches; and
   iii) a second conductive strap having a plurality of second strap projecting pivotal ends, each of the plurality of second strap projecting pivotal ends being located in one of the plurality of notches; and b) a plurality of socket units, each of the plurality of socket units being pivotally connected in one of the plurality of notches and having:
   i) a plurality of flanges;
   ii) two insertion openings;
   iii) a first insertion strap located between two of the plurality of flanges and pivotally connected to one of the plurality of first strap projecting pivotal ends, the first insertion strap aligning with a first of the two insertion openings; and
   iv) a second Insertion strap located between two of the plurality of flanges and pivotally connected to one of the plurality of second strap projecting pivotal ends, the second insertion strap aligning with a second of the two insertion openings.

2. The multiple socket according to claim 1, wherein the housing includes a plurality of switches, each of the plurality of switches is electrically connected to one of the plurality of socket units.

3. The multiple socket according to claim 1, wherein each of the plurality of switches includes an indication lamp.

4. The multiple socket according to claim 1, wherein each of the plurality of socket units includes an aperture, one of the plurality of first strap projecting pivotal ends and one of the plurality of second strap projecting pivotal ends is inserted through the aperture of each of the plurality of socket units.

* * * * *